US009920584B2

(12) United States Patent
Pelto et al.

(10) Patent No.: US 9,920,584 B2
(45) Date of Patent: Mar. 20, 2018

(54) COLLET LOCK ASSEMBLY AND METHOD FOR DOWNHOLE LOAD DIVERSION

(71) Applicant: Halliburton Energy Services, Inc., Houston, TX (US)

(72) Inventors: Christopher Michael Pelto, Garland, TX (US); Jeremy Lynn Stanley, Little Elm, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 389 days.

(21) Appl. No.: 14/437,749

(22) PCT Filed: Nov. 13, 2012

(86) PCT No.: PCT/US2012/064794
§ 371 (c)(1),
(2) Date: Apr. 22, 2015

(87) PCT Pub. No.: WO2014/077800
PCT Pub. Date: May 22, 2014

(65) Prior Publication Data

US 2015/0300114 A1 Oct. 22, 2015

(51) Int. Cl.

| | |
|---|---|
| ***E21B 23/01*** | (2006.01) |
| ***E21B 33/129*** | (2006.01) |
| ***E21B 23/06*** | (2006.01) |

(52) U.S. Cl.
CPC ..... *E21B 23/01* (2013.01); *E21B 23/06* (2013.01); *E21B 33/1293* (2013.01)

(58) Field of Classification Search
CPC ..... E21B 23/01; E21B 33/1293; E21B 23/06
See application file for complete search history.

(56) References Cited

U.S. PATENT DOCUMENTS

| | | | | |
|---|---|---|---|---|
| 4,469,173 | A | 9/1984 | Gilbert et al. | |
| 6,202,747 | B1 * | 3/2001 | Lacy | E21B 33/1295 166/120 |
| 6,408,946 | B1 | 6/2002 | Marshall et al. | |
| 6,629,563 | B2 | 10/2003 | Doane | |
| 7,426,964 | B2 | 9/2008 | Lynde et al. | |
| 2009/0065217 | A1 | 3/2009 | Ross | |
| 2010/0012330 | A1 | 1/2010 | Ezell et al. | |
| 2011/0114325 | A1 | 5/2011 | Coghill et al. | |
| 2012/0012303 | A1 | 1/2012 | Xu | |
| 2014/0299329 | A1 * | 10/2014 | Kippola | E21B 21/103 166/373 |

OTHER PUBLICATIONS

International Search Report and the Written Opinion of the International Searching Authority, or the Declaration, dated May 14, 2013, PCT/US2012/064794, 8 pages, ISA/KR.

* cited by examiner

*Primary Examiner* — Michael R Wills, III

(57) ABSTRACT

A collet lock assembly for use on a downhole tool allows repeat cycling of a "RELEASE" and "SET" position. In the "RELEASE" position, the collet lock assembly allows bi-directional relative movement of the mandrel in relation to the collet lock assembly, while in the "SET" position, the assembly allows bi-directional load transfer along the mandrel directly into the slip assembly while diverting axial loads away from components positioned along the downhole tool.

20 Claims, 6 Drawing Sheets

LOCKED RELEASE POSITION
RELEASE POSITION (After screw 22 is sheared)

SET POSITION

COLLET LOCK ASSEMBLY AND METHOD FOR DOWNHOLE LOAD DIVERSION

The present application is a U.S. National Stage patent application of International Patent Application No. PCT/US2012/064794, filed on Nov. 13, 2012, the benefit of which is claimed and the disclosure of which is incorporated herein by reference in its entirety.

FIELD OF THE INVENTION

The present invention relates generally to collet lock assemblies and, more particularly, to a collet lock assembly which maintains switchable states of either bi-directional relative movement or bi-directional load transfer to allow diversion of axial loading away from components of a downhole assembly.

BACKGROUND

In conventional downhole assemblies, various components are positioned along the assemblies. A packer element is one such component that is utilized to isolate portions of the wellbore. When a packer is activated, it exerts a radial compressive force on the mandrel which, in turn, applies a collapse pressure on the mandrel. In addition, axial forces applied to the tool can act on the packer to create tensile or compressive forces within the mandrel, thus increasing the risk of crushing the mandrel or increasing the risk of bursting the mandrel above the elements in situations of applied internal pressure. Depending on tool configuration, these axial forces can also be directed through the elements, thus greatly increasing the resulting radially applied collapse pressure on the mandrel.

In the conventional art, there are devices which allow for some control of these axial load paths. Body lock rings and internal slips are two methods to allow for the desired load diversion. These are, however, limited by the fact that they only allow free movement in one direction and load transfer in the opposite direction. They are further limited by their inability to be released from their directional load transfer. Once they are engaged, they cannot be released.

In view of the foregoing, there is a need in the art for a tool which allows axial loads along the tool to be isolated from tool components, while also allowing for bi-directional movement when disengaged, bi-directional load transfer while engaged, and a method for switching between these states.

DESCRIPTION OF ILLUSTRATIVE EMBODIMENTS

Illustrative embodiments and related methodologies of the present invention are described below as they might be employed in a load diverting collet lock assembly. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. In addition, although this description may refer to left, right, up or down to describe certain components in relation to one another, such terminology is used for illustrative purposes only. Further aspects and advantages of the various embodiments and related methodologies of the invention will become apparent from consideration of the following description and drawings.

Figure 1A:
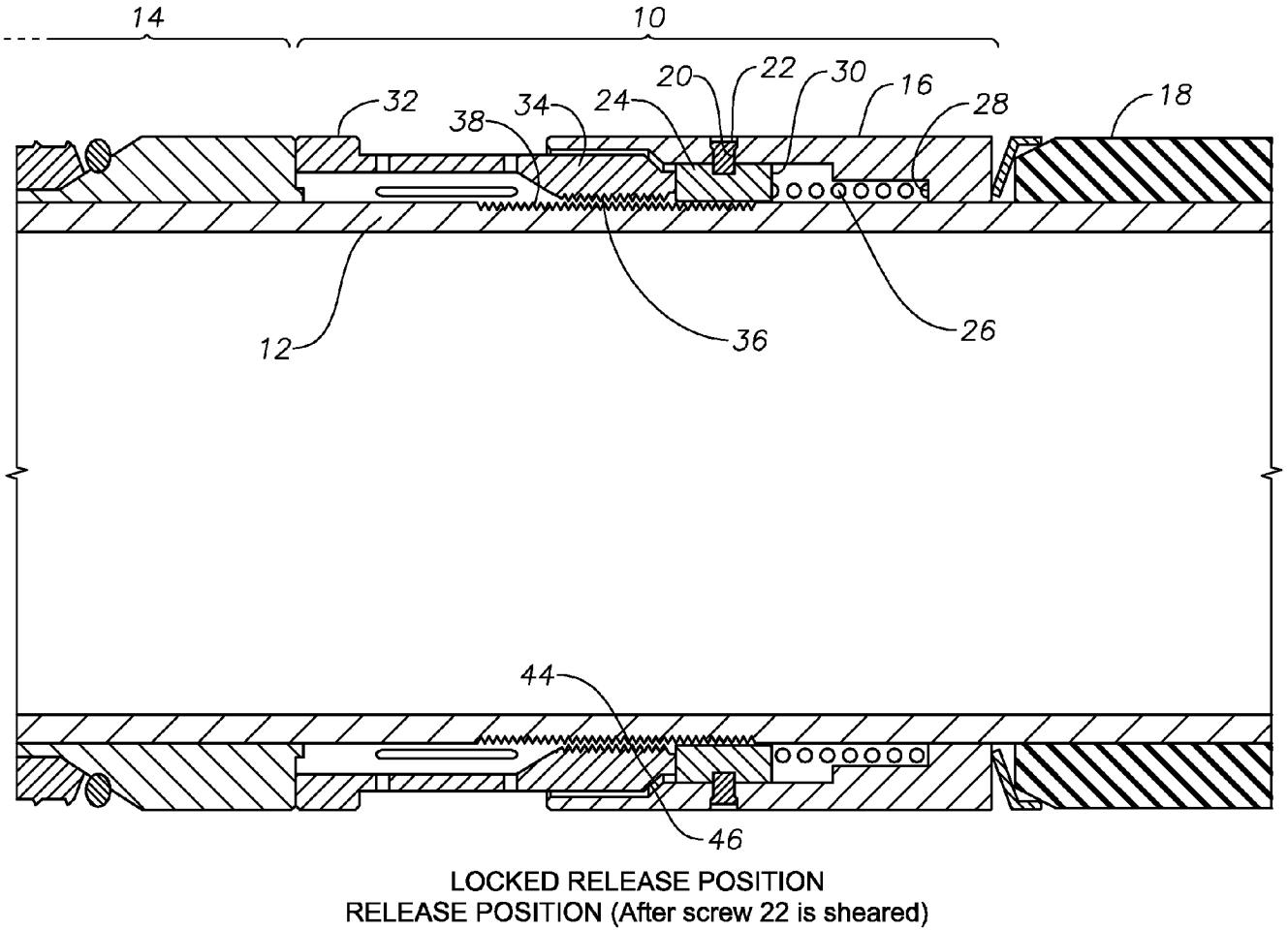
FIG. 1A is a cross-sectional view of a collet lock assembly in the "LOCKED RELEASE" position/"RELEASE" position (after screw 22 has been sheared) according to exemplary embodiments of the present invention.

FIG. 1A is a cross-sectional view of a collet lock assembly 10 positioned along a downhole tool according to certain exemplary embodiments of the present invention. In this exemplary embodiment, collet lock assembly 10 is mounted on a mandrel 12 which may be, for example, a packer assembly or some other string assembly, as will be understood by those ordinarily skilled in the art having the benefit of this disclosure. As will be described herein, exemplary embodiments of collet lock assembly 10 allow repeat "RELEASE" and "SET" cycling of a downhole tool. In the "RELEASE" position, collet lock assembly 10 allows mandrel 12 to move bi-directionally in relation to collet lock assembly 10. Once in the "SET" position, collet lock assembly 10 then prevents mandrel 12 from moving in either direction, thus allowing bi-directional force transfer directly into the slip assembly 14, thus bypassing certain tool components, such as, for example, a set of packer elements 18, along mandrel 12. Thereafter, collet lock assembly 10 may be put into the "RELEASE" position, whereby bi-directional movement of mandrel 12 is once again allowed. In this exemplary embodiment, this process only occurs once. However, in an alternate embodiment as described herein, this cycle may be repeated as desired. In addition to the foregoing, exemplary embodiments of collet lock assembly 10 eliminate or redirect the axial loading away from components of the downhole tool such as, for example, packer elements 18, thus also reducing or eliminating the radial compressive loads applied to the mandrel.

As described herein, collet lock assembly 10 comprises part of a packer assembly. However, those ordinarily skilled in the art having the benefit of this disclosure realize that collet lock assembly 10 may form part of a variety of other downhole assemblies, such as, for example, line hangers, bridge plugs, sand control devices, running tools, etc. As also understood by those same skilled persons, such assemblies comprise certain components, such as, for example, a packer element, in those embodiments forming part of a packer assembly. Other components may also include, for example, collets, thin walled components or non-metallic items. Therefore, in addition to the packer element as described herein, exemplary embodiments of the collet lock assembly 10 would also divert axial loads away from these other components which may be utilized on those other downhole assemblies.

FIG. 1A illustrates collet lock assembly 10 in a "LOCKED RELEASE" position. In this exemplary embodiment, a slip assembly 14 is positioned above collet lock assembly 10. As understood in the art, slip assembly 14 is utilized to engage the casing, thus retaining collet lock assembly 10 in the casing. In this embodiment, collet lock assembly 10 forms part of a packer assembly. Thus, a packer element 18 such as, for example, a three piece element stack with support and retainer shoes, is positioned below collet lock assembly 10. Collet lock assembly 10 includes a cylindrical assembly housing 16 which includes one or more bores 20 for a loading device, such as, for example, a shearing screw 22 and shear ring 24. As described herein, shearing screw 22 is selected such that it can withstand the force necessary to set slip assembly 14 before it shears, as will be understood by those ordinarily skilled in the art having the benefit of this disclosure. In addition, other loading devices may be utilized in place of shearing screw 22 and shear ring 24 such as, for example, driv-loc pins, magnetic locks, twist locks, control driven electronic or pressure sensing locks, explosive charge or spring 26.

A shear ring 24 is positioned between housing 16 and mandrel 12. A spring 26, such as, for example, a hydraulic or coiled spring, is positioned beneath shear ring 24 where it abuts against a shoulder 28 of housing 16 and surface 30 of shear ring 24, thus providing a resistive force against shear ring 24. A collet 32 having a plurality of resilient fingers 34 is positioned at the upper end of collet lock assembly 10. As shown, fingers 34 extend down along the inner diameter of housing 16. Fingers 34 comprise a series of teeth 36 along its inner surface in order to grippingly engage a threaded, or teethed, profile 38 of mandrel 12.

As previously mentioned, FIG. 1A illustrates collet lock assembly 10 in the "LOCKED RELEASE" position. Collet lock assembly 10 of FIG. 1A is considered in a "LOCKED RELEASE" position because shear screw 22 has not been sheared, thus retaining collect lock assembly 10 in a locked configuration. However, once shear screw 22 has been sheared, collect lock assembly 10 is then in a "RELEASE" position. Nevertheless, in this "LOCKED RELEASE" position, there is no axial force acting upon fingers 34 to force teeth 36 to engage mandrel 12. As such, a downhole assembly (such as, for example, the packer assembly of FIG. 1A) comprising collet lock assembly 10 may be deployed downhole for any variety of operations such as, for example, line hangers, packers, bridge plugs, sand control devices, retrieving tools or running tool operations. Whenever collet lock assembly 10 is in the "LOCKED RELEASE" or "RELEASE" position, mandrel 12 is allowed to axially move bi-directionally in relation to collet lock assembly 10, as illustrated by the arrows. Below, the setting of collet lock assembly 10 will be described.

Figure 1B:
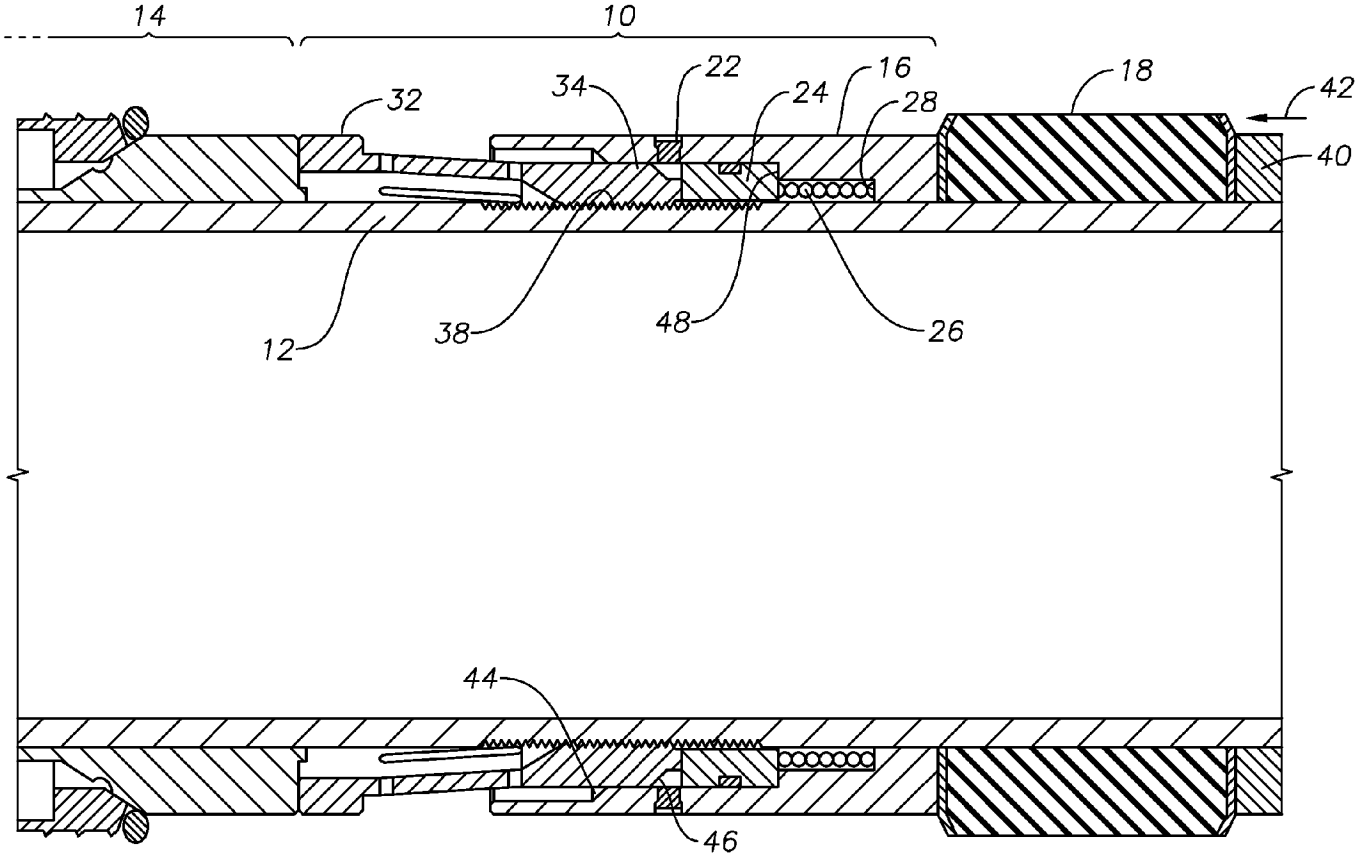
FIG. 1B is a cross-sectional view of a collet lock assembly in the "SET" position according to exemplary embodiments of the present invention.

FIG. 1B illustrates collet lock assembly 10 in the "SET" position. In order to set collet lock assembly 10, an axial compressive force 42 is applied to packer element 18. In this exemplary embodiment, a setting piston 40 is utilized to accomplish the compressive force. However, in another exemplary embodiment, a linear actuator, spring, hydrostatic piston or axial screw, for example, may also be utilized. Nevertheless, once axial compressive force 42 is applied, the force is transferred to shear screw 22 which, in turn, causes collet lock assembly 10 in its entirety to move upwardly. As collet lock assembly 10 continues to move upwardly, slip assembly 14 is set. As previously discussed, shear screw 22 is selected to have a strength such that slip assembly 14 is set before it shears.

Still referring to FIG. 1B, as the axial compression force 42 continues to be applied by setting piston 40, shear screw 22 shears and releases housing 16 to move in relation to shear ring 24 and fingers 34. Now, as previously described, collect lock assembly 10 is in the "RELEASE" position. Housing 16 then continues to move along mandrel 12 until shear ring 24 abuts shoulder 48 of housing 16. In doing so, angular mating surfaces 44 and 46 of housing 16 and fingers 34, respectively, slidingly engage one another, thus forcing fingers 34 into gripping engagement with profile 38 of mandrel 12. Accordingly, collet lock assembly 10 is now in the "SET" position. In this position, bi-directional axial loads along mandrel 12 may be transferred to slip assembly 14, thus bypassing other components along mandrel 12. Once in the "SET" position, any variety of downhole operations may be conducted as would be understood by those ordinarily skilled in the art having the benefit of this disclosure. Collet lock assembly 10 will remain in the "SET" position until axial compressive force 42 is removed.

When deactivation of collet lock assembly 10 is desired, packer piston 40 is deactivated, thus removing axial compressive force 42. Those ordinarily skilled in the art having the benefit of this disclosure realize there are a variety of methods in which to deactivate the piston. Nevertheless, thereafter packer element 18 is released and the energy stored in spring 26 acts against shoulder 28 of housing 16 to force housing 16 back down to the "RELEASE" position (which, in this embodiment, is shown in FIG. 1A, except that shear screw 22 has been sheared). This, in turn, allows fingers 34 to release mandrel 12, thus allowing bi-directional movement of mandrel 12 once again.

Hereafter, in certain exemplary embodiments, the "RELEASE" and "SET" positions may be re-cycled any number of times as previously stated. In this embodiment, however, the spring constant of spring 26 must be greater than the force required to set slip assembly 14. Thus, to reset collet lock assembly 10 in the "SET" position, packer piston 40 is activated once again to apply axial compressive force 42, whereby collect lock assembly 10 moves upwardly in its entirety until slip assembly 14 is set. Continued application of axial compressive force 14 then results in compression of spring 26, whereby angular surfaces 44 of housing 16 and angular surface 46 of fingers 34 slidingly mate with one another once again to force fingers 34 to grip mandrel 12.

Moreover, in an alternative embodiment, shearing screw 22 and shear ring 24 are not utilized. Instead, spring 26, having a spring constant greater than the force required to set slip assembly 14, is utilized. As previously described, spring 26 would then provide the dual functionality of setting the slip assembly in response to the compressive force 42, then also releasing housing 16 to set fingers 34. Furthermore, this exemplary embodiment of the collet lock assembly 10 may also be cycled between the "RELEASE" and "SET" positions as described herein.

Figure 2A:
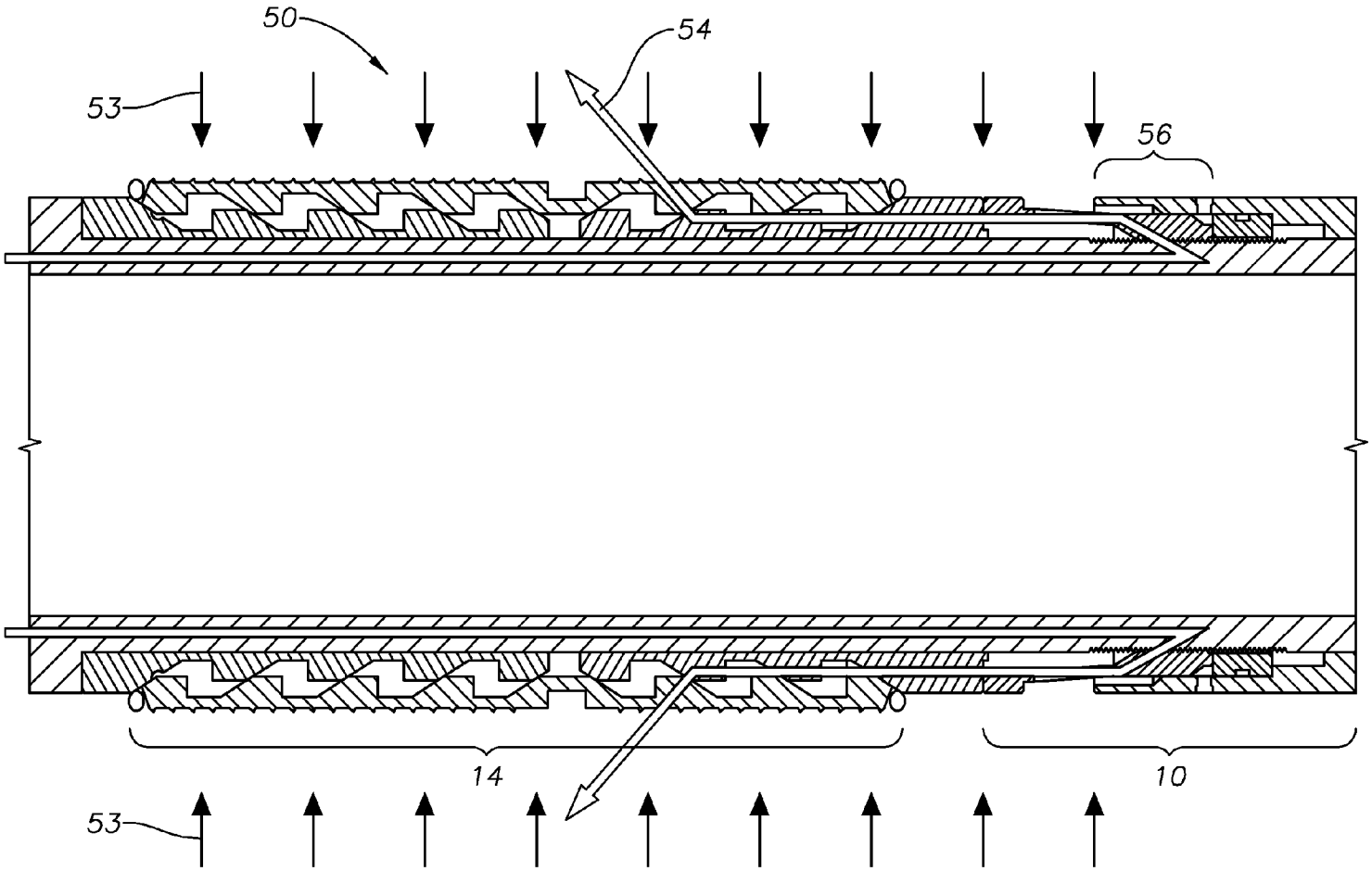
FIGS. 2A and 2B are cross-sectional views which illustrate the tensile path effects on a downhole assembly in accordance with exemplary embodiments of the present invention.
Figure 2B:
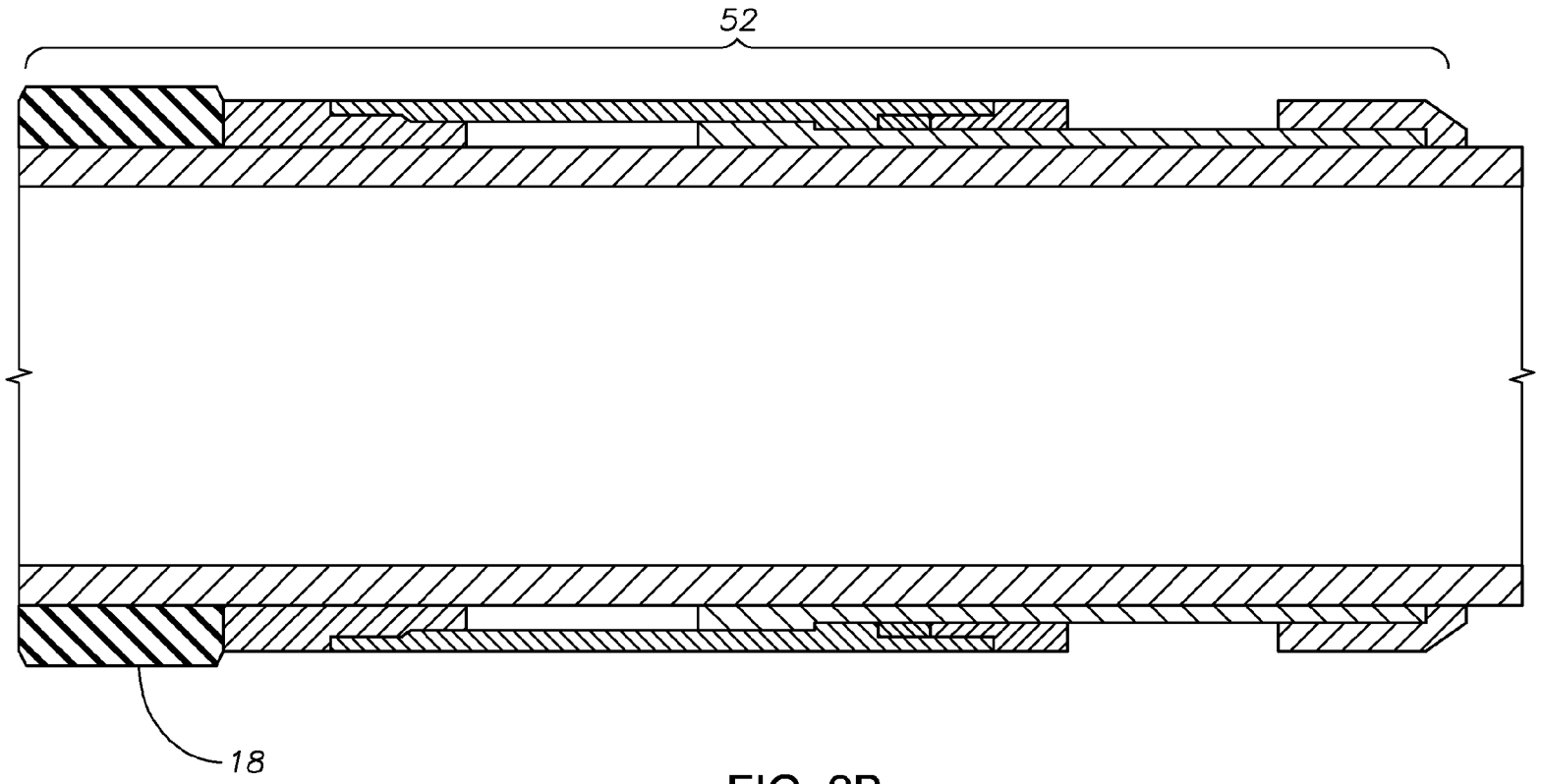

It will now be described how exemplary embodiments of collet lock assembly 10 redirect the axial loading forces passing through various downhole components. In doing so, the present invention allows the use of less expensive tubing materials since less compressive load resistance is required. FIGS. 2A and 2B illustrate a downhole assembly 50 which includes collet lock assembly 10 as described herein. Downhole assembly 50 may be, for example, a 10¾" 55.5 lb/ft DHC Packer Assembly. In addition, downhole assembly 50 also includes a plurality of components 52 that, in this embodiment, include one or more packer elements 18. However, as previously described, other components may be present in other assemblies.

Still referring to FIGS. 2A and 2B, arrow 54 indicates the path of a tensile, or axial, force applied to downhole assembly 50. If collet lock assembly 10 were not utilized, the path of the tensile force would not only extend through slip assembly 14, but would also extend down through components 52. Thus, in this exemplary embodiment, the application of this tensile force through components 52 would result in additional radial compressive forces along components 52 on mandrel 12, thus increasing the collapse pressure on mandrel 12. As well understood in the art, once the collapse pressure reaches a certain threshold, mandrel 12 will be crushed.

Figure 3A:
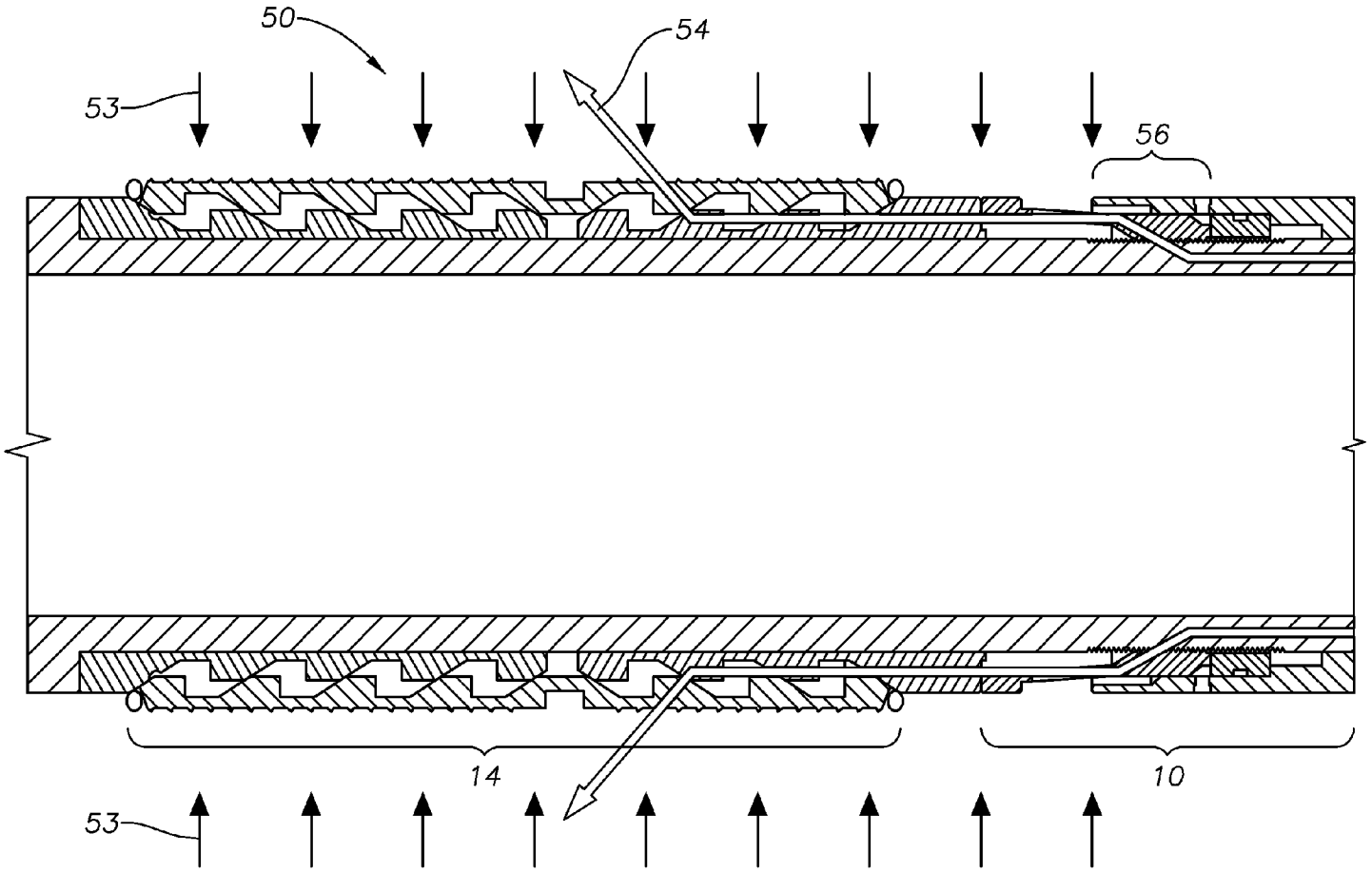
FIGS. 3A and 3B are cross-sectional views which illustrate the tensile path effects originating from below a downhole assembly in accordance with exemplary embodiments of the present invention.
Figure 3B:
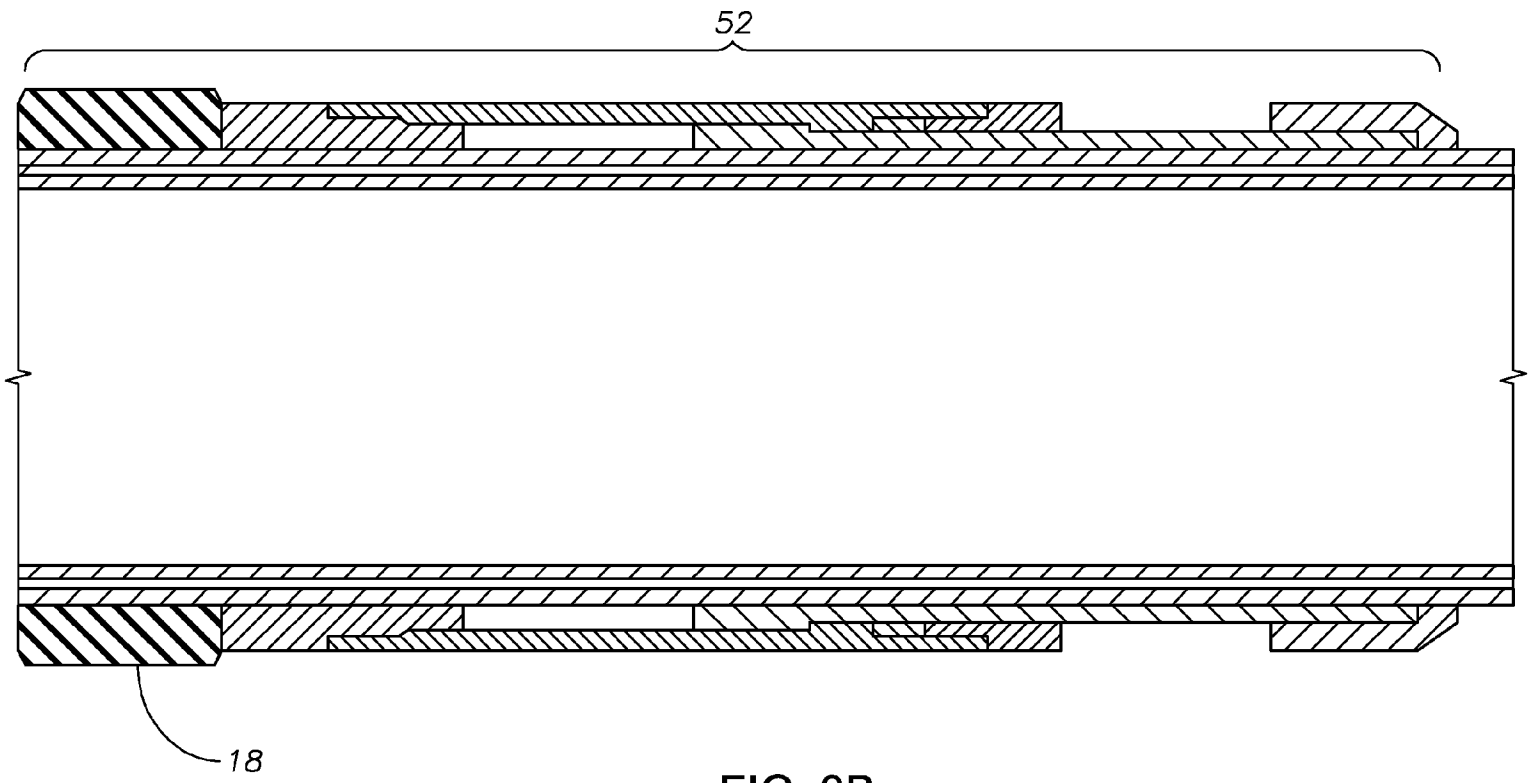

However, through use of collet lock assembly 10 as shown in FIGS. 2A and 2B, tensile path 54 is prevented from passing through packer element 18 thus reducing and/or eliminating the radial compressive force applied by packer element 18. Here, in this exemplary embodiment, once collet lock assembly 10 is in the "SET" position, the tensile path 54 is concentrated along collet area 56 (where fingers 34 engage mandrel 12), the section of mandrel 12 above collet lock assembly 10, and slip assembly 14. Therefore, the tensile force never acts upon packer element 18 in order to create their corresponding radial FIGS. 3A and 3B will now illustrate how exemplary embodiments of the present invention may be utilized to redirect compressive forces generated below collet lock assembly 10 away from components 52. Here, all components are identical to the exemplary embodiment of FIGS. 2A and 2B. As understood in the art, pressures below exemplary downhole assembly 50 push upwardly on downhole assembly 50, thus inducing a compressive force through packer element 18 which increases the collapse propensity through pressure applied to mandrel 12. However, through the use of collet lock assembly 10 (in the "SET" position), tensile path 54 passes beneath packer element 18 and concentrates along collet lock assembly 10 and slip assembly 14. As such, the pressure beneath collet lock assembly 10 no longer induces a compressive force through packer element 18.

Accordingly, exemplary embodiments of the present invention allow conditional, bi-directional load transfer between two sliding components. In the "RELEASE" position, no load transfer is possible, but bi-directional motion is allowed. Upon activation in the "SET" position, motion will be restricted and loads may be transferred in both directions. Therefore, axial loads in the tooling string, for example, may be isolated from tool components and driven directly into the external slips. This, in turn, reduces the number of combined loading effects which diminish the effective pressure/tension/compression loads that a packer may withstand.

An exemplary embodiment of the present invention provides a downhole assembly to divert axial loading away from a component of the downhole assembly, the assembly comprising a mandrel, a slip assembly positioned along the mandrel, a collet lock assembly positioned along the mandrel, the collet lock assembly comprising a plurality of collet fingers extending therefrom, the collet fingers comprising a first angular surface on an outer surface of the collet fingers, an assembly housing positioned along the mandrel at an end of the collet lock assembly opposite the collet, the assembly housing comprising a second angular surface on an inner surface of the assembly housing, and a loading device positioned along the collet lock assembly, and an assembly component positioned along the mandrel, wherein the loading device is adapted to release the assembly housing after the slip assembly has been set, thus allowing the second angular surface of the assembly housing to slidingly mate with the first angular surface to force the collet fingers to grip the mandrel in order to provide bi-directional axial load transfer to the slip assembly.

In another embodiment, the collet lock assembly diverts the bi-directional axial load away from the assembly component when the collet fingers grip the mandrel. In yet another, the assembly component is a packer element. In another, the loading device comprises a shear screw position along the assembly housing and a shear ring positioned between the assembly housing and the mandrel, the shear screw being coupled to the shear ring. Yet another embodiment comprises a spring positioned between the assembly housing and the shear ring such that the shear ring is biased away from the assembly housing. In another, the assembly housing is adapted to be released from the collet fingers to allow the collet fingers to disengage from the mandrel, thus allowing bi-directional movement of the mandrel relative to the collet lock assembly. In yet another, the loading device comprises a spring positioned between the assembly housing and a shear ring.

Another exemplary embodiment of the present invention provides a collet lock assembly to divert axial loading away from a component positioned along a mandrel, the collet lock assembly comprising a collet comprising a plurality of collet fingers extending therefrom, the collet fingers comprising a first angular surface on an outer surface of the collet fingers, an assembly housing positioned at an end of the collet lock assembly opposite the collet, the assembly housing comprising a second angular surface on an inner surface of the assembly housing and a loading device adapted to release the assembly housing after a slip assembly positioned along the mandrel has been set, thus allowing the second angular surface of the assembly housing to slidingly mate with the first angular surface to force the collet fingers to grip the mandrel in order to provide bi-directional axial load transfer to the slip assembly.

In another embodiment, the collet lock assembly diverts the bi-directional axial load away from the component once the collet fingers grip the mandrel. In yet another, the component is a packer element. In another, the loading device comprises a shear screw position along the assembly housing and a shear ring positioned between the assembly housing and the mandrel, the shear screw being coupled to the shear ring. Another exemplary embodiment comprises a spring positioned between the assembly housing and the shear ring such that the shear ring is biased away from the assembly housing. In yet another, the assembly housing is adapted to be released from the collet fingers to allow the collet fingers to disengage from the mandrel, thus allowing bi-directional movement of the mandrel relative to the collet lock assembly. In another, the loading device comprises a spring positioned between the assembly housing and a shear ring.

An exemplary methodology of the present invention provides a method to divert axial loading away from a component of a downhole assembly, the method comprising exerting an axial force in a first direction along a mandrel, the axial force being transferred through a collet lock assembly to a slip assembly, setting the slip assembly using the axial force, continuing to apply the axial force in the first direction to force a loading device to release a housing of the collet lock assembly to engage a surface of a collet finger, thus forcing the collet finger into gripping engagement with the mandrel and transferring axial loading into the slip assembly, wherein the axial loading is diverted away from the component. Another method further comprises removing the axial force, causing the housing of the collet lock assembly to move in a second direction opposite the first direction, disengaging the collet finger from the mandrel, and allowing bi-directional movement of the mandrel in relation to the collet lock assembly.

Yet another method further comprises re-exerting the axial force in the first direction along a mandrel, re-setting the slip assembly using the axial force, continuing to apply the axial force in the first direction to force the loading device to release the housing of the collet lock assembly to engage the surface of the collet finger, thus forcing the collet finger into gripping engagement with the mandrel and transferring the axial loading into the slip assembly, wherein the axial loading is diverted away from the component. In another, the axial loading diverted away from the component is a bi-directional axial load. In yet another, the component is a packer element. In another method, the loading device is at least one of a shearing device or a spring.

The foregoing description and figures are not drawn to scale, but rather are illustrated to describe various embodiments of the present invention in simplistic form. Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Accordingly, the intention is to cover all modifications, equivalents and alternatives falling within the spirit and scope of the invention as defined by the appended claims.

What is claimed is:

1. A downhole assembly to divert axial loading away from a component of the downhole assembly, the assembly comprising:

a mandrel;

a slip assembly positioned along the mandrel;

an assembly component positioned along the mandrel; and a collet lock assembly positioned along the mandrel, the collet lock assembly comprising:

a collet having a plurality of collet fingers, the collet fingers comprising a first angular surface on an outer surface of the collet fingers;

an assembly housing positioned along the mandrel at an end of the collet lock assembly opposite the collet, the assembly housing comprising a second angular surface on an inner surface of the assembly housing; and a loading device positioned along the collet lock assembly, the loading device operably coupling the collet and the assembly housing to move together along the mandrel in a first axial direction to set the slip assembly;

wherein the loading device is adapted to release the assembly housing from the collet to permit further movement of the assembly housing in the first axial direction along the mandrel with respect to the collet after the slip assembly has been set, thus allowing the second angular surface of the assembly housing to slidingly mate with the first angular surface to force the collet fingers to grip the mandrel in order to provide bi-directional axial load transfer to the slip assembly.

2. The downhole assembly as defined in claim 1, wherein the collet lock assembly diverts the bi-directional axial load away from the assembly component when the collet fingers grip the mandrel.

3. The downhole assembly as defined in claim 2, wherein the assembly component is a packer element.

4. The downhole assembly as defined in claim 1, wherein the loading device comprises: a shear screw position along the assembly housing; and a shear ring positioned between the assembly housing and the mandrel, the shear screw being coupled to the shear ring.

5. The downhole assembly as defined in claim 4, further comprising a spring positioned between the assembly housing and the shear ring such that the shear ring is biased away from the assembly housing.

6. The downhole assembly as defined in claim 1, wherein the assembly housing is adapted to be released from the collet fingers to allow the collet fingers to disengage from the mandrel, thus allowing bi-directional movement of the mandrel relative to the collet lock assembly.

7. The downhole assembly as defined in claim 1, wherein the loading device comprises a spring positioned between the assembly housing and a shear ring.

8. A collet lock assembly to divert axial loading away from a component positioned along a mandrel, the collet lock assembly comprising:

a collet comprising a plurality of collet fingers extending therefrom, the collet fingers comprising a first angular surface on an outer surface of the collet fingers;

an assembly housing positioned at an end of the collet lock assembly opposite the collet, the assembly housing comprising a second angular surface on an inner surface of the assembly housing; and a loading device operably coupling the collet and the assembly housing to move together along the mandrel in a first axial direction to set a slip assembly, the loading device adapted to release the assembly housing from the collet to permit further movement of the assembly housing in the first axial direction along the mandrel with respect to the collet after the slip assembly has been set, thus allowing the second angular surface of the assembly housing to slidingly mate with the first angular surface to force the collet fingers to grip the mandrel in order to provide bi-directional axial load transfer to the slip assembly.

9. The collet lock assembly as defined in claim 8, wherein the collet lock assembly diverts the bi-directional axial load away from the component once the collet fingers grip the mandrel.

10. The collet lock assembly as defined in claim 9, wherein the component is a packer element.

11. The collet lock assembly as defined in claim 8, wherein the loading device comprises: a shear screw position along the assembly housing; and a shear ring positioned between the assembly housing and the mandrel, the shear screw being coupled to the shear ring.

12. The collet lock assembly as defined in claim 11, further comprising a spring positioned between the assembly housing and the shear ring such that the shear ring is biased away from the assembly housing.

13. The collet lock assembly as defined in claim 8, wherein the assembly housing is adapted to be released from the collet fingers to allow the collet fingers to disengage from the mandrel, thus allowing bi-directional movement of the mandrel relative to the collet lock assembly.

14. The collet lock assembly as defined in claim 8, wherein the loading device comprises a spring positioned between the assembly housing and a shear ring.

15. A method to divert axial loading away from a component of a downhole assembly, the method comprising:

exerting a first axial force in a first direction along a mandrel, the first axial force being transferred through a collet and an assembly housing of a collet lock assembly to a slip assembly;

setting the slip assembly using the first axial force to move the collet and the assembly housing together along the mandrel;

continuing to apply the first axial force in the first direction in combination with a second axial force in the first direction to force a loading device to release the assembly housing of the collet lock assembly from the collet to permit the assembly housing to engage a surface of a collet finger, thus forcing the collet finger into gripping engagement with the mandrel; and transferring axial loading into the slip assembly, wherein the axial loading is diverted away from the component.

16. The method as defined in claim 15, further comprising:

removing the axial force;

causing the housing of the collet lock assembly to move in a second direction opposite the first direction;

disengaging the collet finger from the mandrel; and allowing bi-directional movement of the mandrel in relation to the collet lock assembly.

17. The method as defined in claim 16, further comprising:

re-exerting the axial force in the first direction along a mandrel;

re-setting the slip assembly using the axial force;

continuing to apply the axial force in the first direction to force the loading device to release the housing of the collet lock assembly to engage the surface of the collet finger, thus forcing the collet finger into gripping engagement with the mandrel; and transferring the axial loading into the slip assembly, wherein the axial loading is diverted away from the component.

18. The method as defined in claim 15, wherein the axial loading diverted away from the component is a bi-directional axial load.

19. The method as defined in claim 15, wherein the component is a packer element.

20. The method as defined in claim 15, wherein the loading device is at least one of a shearing device or a spring.

* * * * *